US010245478B2

(12) United States Patent
Narita et al.

(10) Patent No.: US 10,245,478 B2
(45) Date of Patent: Apr. 2, 2019

(54) GOLF CLUB HEAD

(71) Applicant: Bridgestone Sports Co., Ltd., Tokyo (JP)

(72) Inventors: Tadahiro Narita, Yokohama (JP); Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 15/251,240

(22) Filed: Aug. 30, 2016

(65) Prior Publication Data

US 2017/0128791 A1 May 11, 2017

(30) Foreign Application Priority Data

Nov. 6, 2015 (JP) ..... 2015/218751

(51) Int. Cl.
*A63B 53/02* (2015.01)
*A63B 53/04* (2015.01)
*A63B 60/52* (2015.01)

(52) U.S. Cl.
CPC ..... *A63B 53/0466* (2013.01); *A63B 53/02* (2013.01); *A63B 60/52* (2015.10); *A63B 2053/0408* (2013.01); *A63B 2053/0437* (2013.01); *A63B 2225/01* (2013.01)

(58) Field of Classification Search
CPC ..... A63B 53/0466
See application file for complete search history.

(56) References Cited

U.S. PATENT DOCUMENTS 2,550,846 A * 5/1951 Milligan ..... A63B 53/04 473/327
3,997,170 A 12/1976 Goldberg
4,065,133 A * 12/1977 Gordos ..... A63B 53/04 473/327
4,930,783 A * 6/1990 Antonious ..... A63B 53/04 473/242
5,467,989 A 11/1995 Good et al.
5,632,695 A * 5/1997 Hlinka ..... A63B 53/02 473/305
8,702,531 B2 * 4/2014 Boyd ..... A63B 53/02 473/305

FOREIGN PATENT DOCUMENTS

JP 3023452 U 4/1996
JP 8-173578 A 7/1996
JP 10-277181 A 10/1998

* cited by examiner

*Primary Examiner* — Michael Dennis
(74) *Attorney, Agent, or Firm* — Sughrue Mion, PLLC

(57) ABSTRACT

A golf club head includes: a crown portion; a sole portion; a face portion; and a hosel portion. The crown portion includes a concave portion that starts from the face portion, passes through a boundary portion of the hosel portion and the crown portion, and extends toward a back side. The concave portion includes a range from the face portion toward the back side where a width of the concave portion is larger than a depth of the concave portion. The range passes on a toe side of the hosel.

7 Claims, 5 Drawing Sheets

GOLF CLUB HEAD

BACKGROUND OF THE INVENTION

Field of the Invention

The present invention relates to a golf club head.

Description of the Related Art

There are proposed techniques to provide a concave portion in a golf club head to improve the performance of the golf club head (U.S. Pat. Nos. 4,065,133 and 3,997,170, Japanese Patent Laid-Open Nos. 10-277181 and 8-173578, and Japanese Utility Model Registration No. 03023452). Such a concave portion may influence the air resistance to the golf club head at impact.

A golf club head includes a hosel portion in which a shaft is inserted. This hosel portion can adversely affect the airflow which flows around the golf club head at impact, thereby worsening the air resistance. If the air resistance worsens, the head speed decreases, and the distance performance of the golf club head deteriorates.

SUMMARY OF THE INVENTION

It is an object of the present invention to suppress the adverse influence of a hosel portion on an airflow that flows around a golf club head at impact.

According to an aspect of the present invention, there is provided a golf club head comprising: a crown portion; a sole portion; a face portion; and a hosel portion, wherein the crown portion includes a concave portion that starts from the face portion, passes through a boundary portion of the hosel portion and the crown portion, and extends toward a back side, the concave portion includes a range from the face portion toward the back side where a width of the concave portion is larger than a depth of the concave portion, and the range passes on a toe side of the hosel.

According to another aspect of the present invention, there is provided a golf club head comprising: a crown portion; a sole portion; a face portion; and a hosel portion, wherein the crown portion includes a concave portion that starts from the face portion, passes a boundary portion of the hosel portion and the crown portion, and extends to a back side, the concave portion passes on a toe side of the hosel portion, and a width of the concave portion increases along an outer face of the hosel portion from a toe-side end of the outer face to a side of the face portion.

Further features of the present invention will become apparent from the following description of exemplary embodiments (with reference to the attached drawings).

DESCRIPTION OF THE EMBODIMENTS

Figure 1:
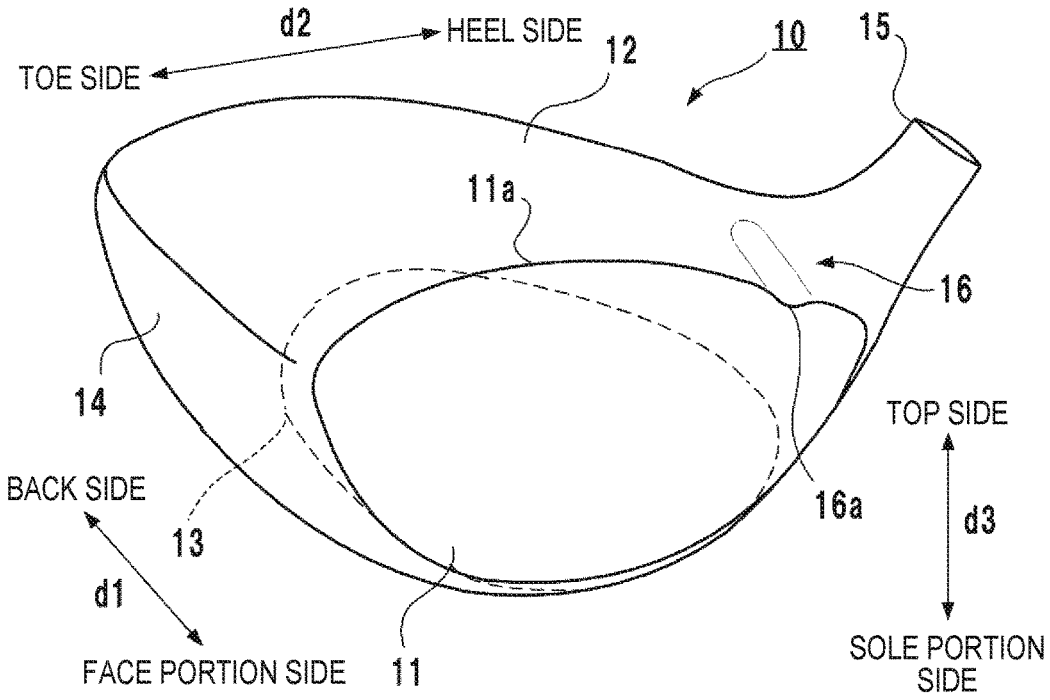
FIG. 1 is a perspective view of a golf club head according to an embodiment of the present invention.

FIG. 1 is a perspective view of a golf club head 10 according to an embodiment of the present invention. The golf club head 10 forms a hollow member. The peripheral walls of the golf club head 10 constitute a face portion 11 that forms a face (striking face), a crown portion 12 that forms the upper portion of the golf club head 10, a sole portion 13 that forms the bottom portion of the golf club head 10, and a side portion 14 that forms the portion between the crown portion 12 and the sole portion 13. The golf club head 10 also includes a hosel portion 15 in which a shaft is inserted and fixed.

In FIGS. 1 and 2, an arrow d1 indicates the face-back direction, an arrow d2 indicates the toe-heel direction, and an arrow d3 indicates the vertical direction. Normally, the face-back direction is to a target line direction (target direction of a shot). The toe-heel direction can be defined as, for example, the direction to connect the toe-side end and the heel-side end of the sole portion 13 or the direction perpendicular to the face-back direction. The vertical direction indicates the vertical direction in a case where the golf club head 10 is grounded according to a predetermined lie angle and a predetermined loft angle, and the side of the crown portion 12 can also be called the top side.

The golf club head 10 is a golf club head for a driver. However, the present invention is applicable to various kinds of golf club heads such as wood type golf club heads including a fairway wood other than drivers, utility (hybrid) golf club heads, and other golf club heads.

The golf club head 10 can be made of a metal material. Examples of the metal material are a titanium-based metal (for example, titanium alloy 6Al-4V-Ti), stainless steel, and a copper alloy such as beryllium copper.

The golf club head 10 can be assembled by joining a plurality of parts. For example, the golf club head 10 can be formed from a body member and a face member. The body member forms the crown portion 12, the sole portion 13, the side portion 14, the hosel portion 15, and a peripheral portion of the face portion 11. The body member includes an opening at a portion corresponding to the face portion 11. The face member is joined to the opening of the body member.

The crown portion 12 includes a concave portion 16 that is recessed toward the side of the sole portion 13 in the direction d3. The concave portion 16 will be described with reference to FIG. 2A to FIG. 4, in addition to FIG. 1.

Figure 2A:
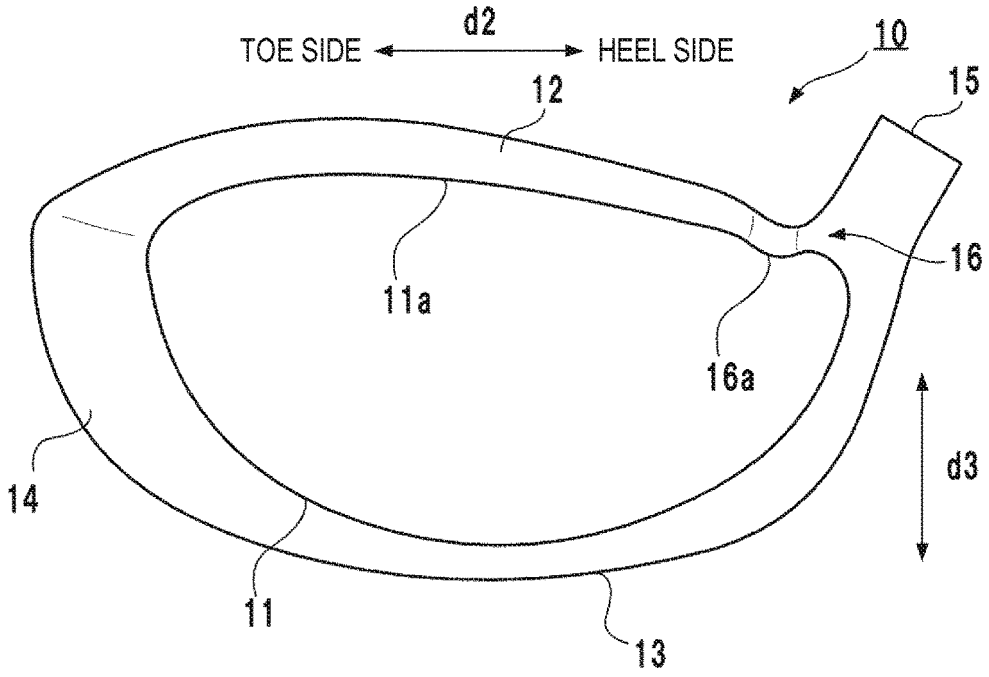
FIG. 2A is a front view showing the golf club head shown in FIG. 1 viewed from a face portion side.
Figure 3A:
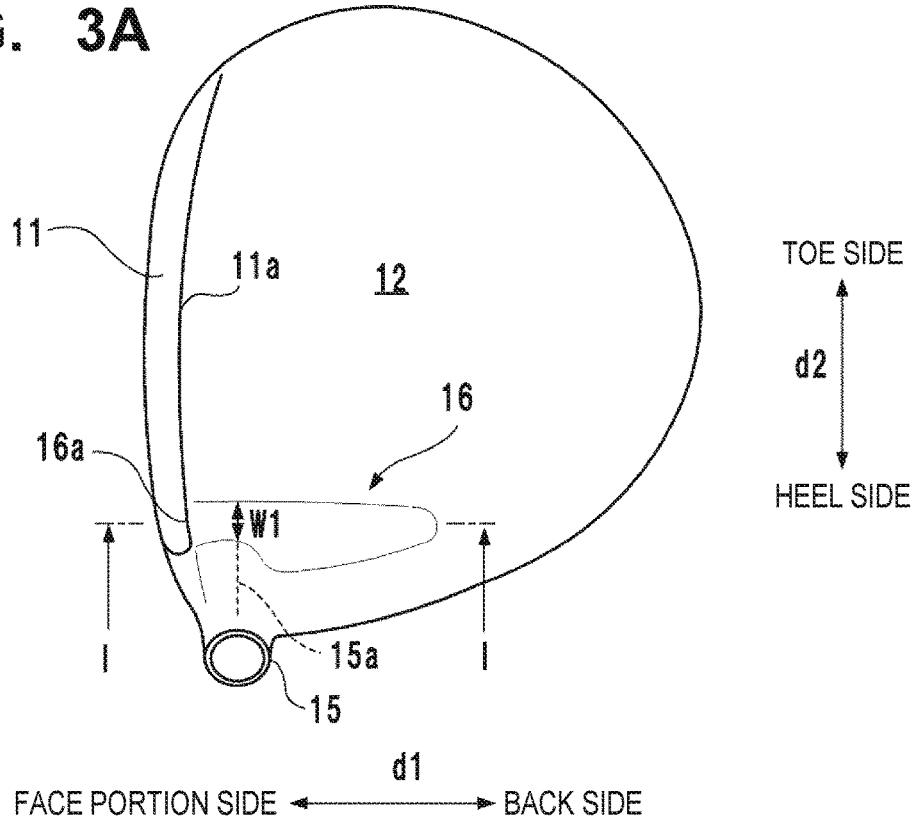
FIG. 3A is a front view showing the golf club head shown in FIG. 1 viewed from a crown portion side.
Figure 4A:
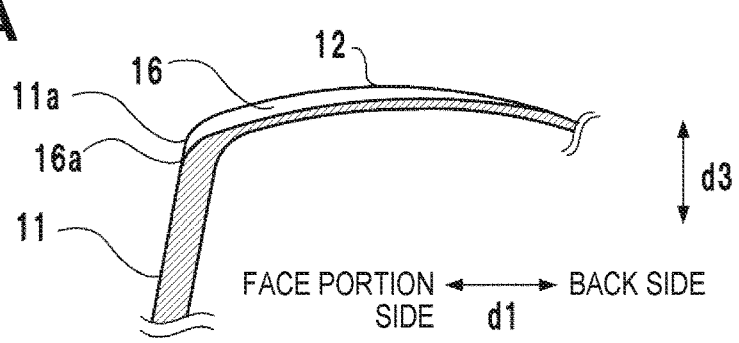
FIG. 4A is a sectional view taken along a line I-I in FIG. 3A.
Figure 4B:
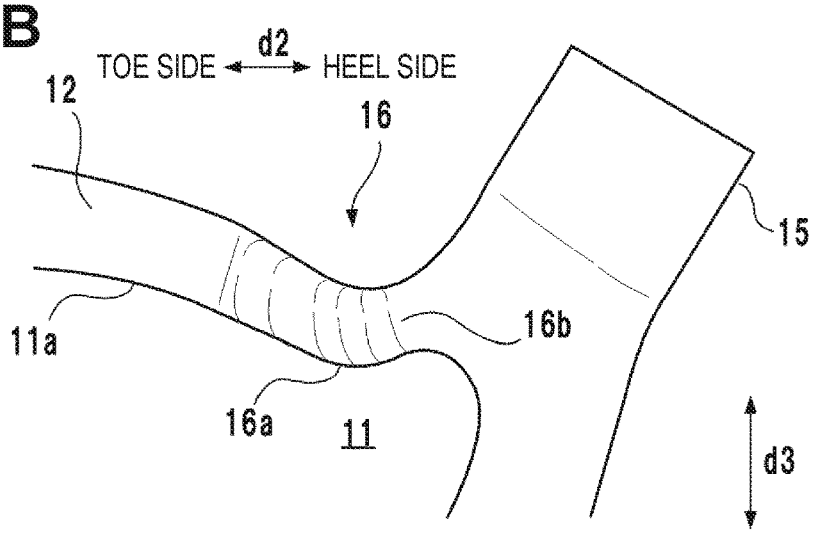
FIG. 4B is an enlarged view showing a concave portion.
Figure 4C:
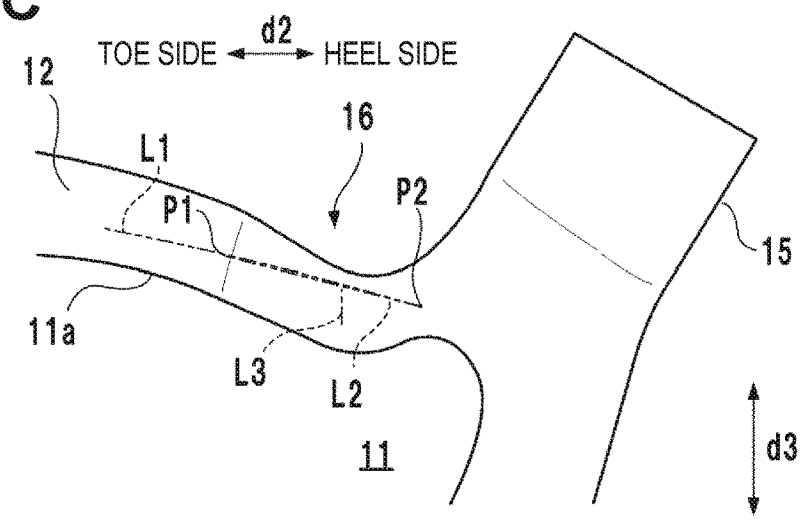
FIG. 4C is a view for explaining the width and the depth of the concave portion.

FIG. 2A is a front view of the golf club head 10 viewed from the side of the face portion 11, and FIG. 3A is a front view of the golf club head 10 viewed from the side of the crown portion 12. FIGS. 2A and 3A are a view from the side of the face portion 11 and a planar view, respectively, in a case where the golf club head 10 is grounded according to a predetermined lie angle and a predetermined loft angle. FIG. 4A is a sectional view taken along a line I-I in FIG. 3A. FIGS. 4B and 4C are enlarged views of the concave portion 16 shown in FIG. 2A.

Figure 2B:
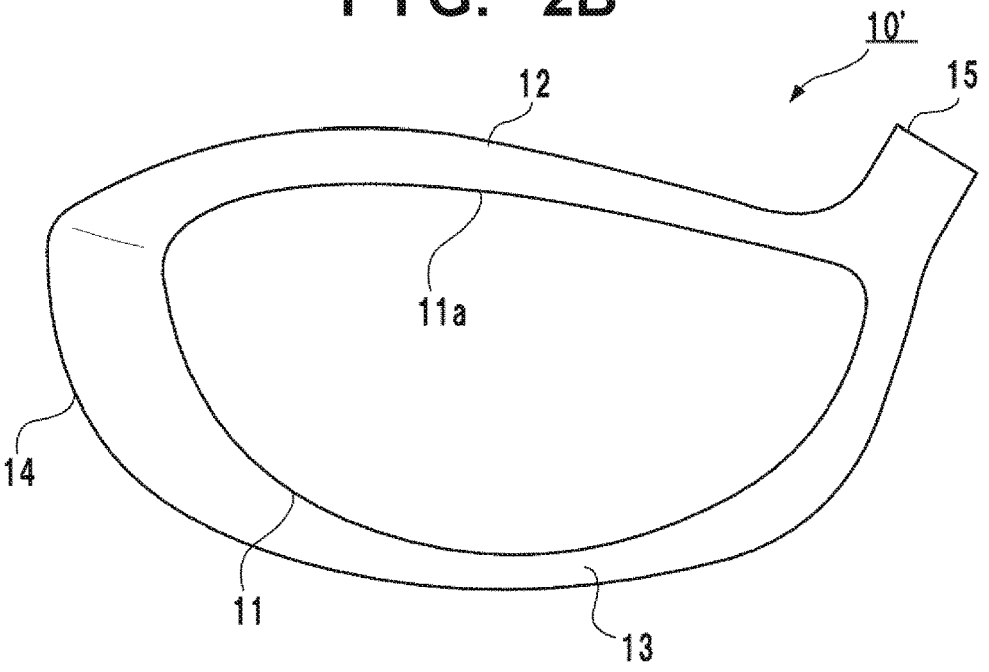
FIG. 2B is a view showing a comparative example.
Figure 3B:
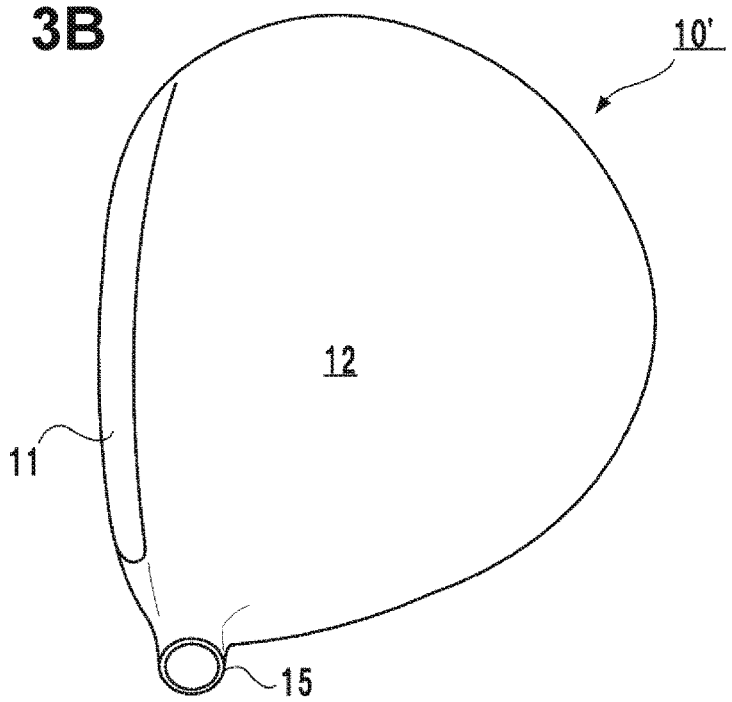
FIG. 3B is a view showing the comparative example.

FIGS. 2B and 3B are a front view and a plan view, respectively, of a golf club head 10' according to a comparative example. The golf club head 10' has the same arrangement as the golf club head 10 except that no concave portion 16 is included and shows an example of a conventional golf club head.

The concave portion 16 extends from the face portion 11 through a boundary portion of the hosel portion 15 and the crown portion 12 toward the back side. The concave portion 16 passes on the toe side of the hosel portion 15 and is not formed on the heel side of the hosel portion 15. The boundary portion of a hosel portion 15 and a crown portion 12 in the conventional golf club head 10', as shown as in FIGS. 2B and 3B, has an upwardly curving contour line from the crown portion 12 to the hosel portion 15 and has a shape which allows an airflow flowing on the toe side of the hosel portion 15 at impact to flow upward relatively easily from the crown portion 12. In contrast, in the embodiment, an airflow flowing on the toe side of the hosel portion 15 at impact is easily guided toward the back side by the concave portion 16, and it is difficult for the airflow to flow upward from the crown portion 12 compared to the conventional golf club head 10'.

The concave portion 16 starts from the face portion 11. An edge 16*a* on the side of the face portion 11 of the concave portion 16 is recessed from an upper edge 11*a* of the face portion 11 to the sole portion 13. Starting the concave portion 16 from the face portion 11 allows the airflow to flow easily into the concave portion 16 at impact. As shown in FIG. 3A, in planar view of the golf club head 10, the edge 16*a* is positioned on the same line as the upper edge 11*a* of the face portion 11 and makes the concave portion 16 into a shape that will not give much sense of incongruity to the golfer at address.

The concave portion 16 has a U-shaped section. One end of the concave portion 16 in the direction d2 is smoothly connected to the upper surface of the crown portion 12, and a part of the other end is smoothly connected to the outer face of the hosel portion 15. A continuously connected J-shaped curved surface 16*b* is formed from the toe-side outer face of the hosel portion 15 to the deepest point of the concave portion 16. By smoothly connecting the concave portion 16 to the peripheral structure, the turbulent airflow around the concave portion can be minimized.

In the case of the embodiment, the hosel portion 15 has a cylindrical shape that has an extended diameter on the side of the base, while a part on the side of the heel of the concave portion 16 is formed along the outer face of the hosel portion 15. Hence, as indicated by a width W1 shown in FIG. 3A, around the hosel portion 15, the width of the concave portion 16 in the direction d2 is smallest at the toe-side end 15*a* of the outer face of the hosel portion 15. The width of the concave portion 16 increases along the outer face of the hosel portion 15 from the toe-side end 15*a* to the side of the face portion 11. That is, since the entrance of the airflow becomes large, the airflow can easily flow into the concave portion 16 at impact. In addition, the width of the concave portion 16 decreases after increasing along the outer face of the hosel portion 15 from the toe-side end 15*a* to the back side. This allows the airflow flowing through concave portion 16 to escape, and it becomes difficult for the airflow to flow upward from the crown portion 12.

Although the end portion on the back side of the concave portion 16 may extend toward the back side of the golf club head 10 while retaining the depth, the concave portion 16 according to the embodiment, as shown in FIG. 4A, continues to the upper surface of the crown portion 12 while the depth gradually decreases toward the back side. In other words, the end portion on the back side of the concave portion 16 is formed so that it is integrated into the crown portion 12. Hence, the concave portion 16 does not visually stand out at address, and the sense of incongruity given to the golfer can be minimal at address. The shape of the end portion on the heel side of the concave portion 16 can be set along the contour of the golf club head 10 toward the back side than the back-side end of the outer face of the hosel portion 15, and the width of the concave portion 16 in the direction d2 can be decreased toward the back side.

In the case of the embodiment, the width of the overall concave portion 16 in the direction d2 is larger than the depth and therefore has a shallow sectional shape. By setting a shallow sectional shape, the airflow is caused to flow more gradually through the concave portion 16 at impact, and the turbulent airflow around the edge 16*a* can be prevented from increasing. It can also prevent concentration of stress around the strength-required hosel portion 15.

To reduce air resistance, the width of the concave portion 16 in the direction d2 is made larger than the depth in a range from the face portion 11 toward the back side, and the range passes on the toe side of the hosel portion 15. In other words, this range is the range from the face portion 11 to the back-side end of the outer surface of the hosel portion 15.

The width and the depth of the concave portion 16 in the direction d2 can be, for example, defined in the following manner. In FIG. 4C, a line L1 is a virtual line extending the contour line of the upper surface of the crown portion 12 to the concave portion 16 in the direction d2. P1 is the position of the boundary (inflection point of the shape) of the line L1, the crown portion 12, and the concave portion 16. P2 is the position where the line L1 crosses the golf club head 10 on a side opposite from P1. The length of a line L2 connecting P1 and P2 is the width of the concave portion 16 at that position. In the case of the example shown in FIG. 4C, the width of the concave portion 16 on the side of the hosel portion 15 is exemplified, and P2 is positioned on the curved surface from the hosel portion 15 to the concave portion 16. As the depth, the maximum length of a vertical line extending from the line L2 to the bottom of the concave portion 16 in the toe-heel direction is used as the depth of the concave portion 16.

The effect of reducing the air resistance can hardly be obtained if the width of the concave portion 16 is too small. The effect of reducing the air resistance can become small if the width of the concave portion 16 is too large. The width of the concave portion 16 can range from, for example, 5 mm (inclusive) to 40 mm (inclusive). Particularly, the width in the case of a golf club head for a driver is, for example, 20 mm (inclusive) to 40 mm (inclusive). The effect of reducing the air resistance can hardly be obtained if the concave portion 16 is too shallow. The effect of reducing the air resistance can become small if the concave portion 16 is too deep. The depth of the concave portion 16 can range from, for example, 1 mm (inclusive) to 10 mm (inclusive) at its deepest point. Particularly, the depth in the case of a golf club head for a driver is, for example, 1.5 mm (inclusive) to 10 mm (inclusive).

To prevent the shape of the crown portion 12 from becoming complex or to prevent giving the golfer a sense of incongruity at address, the crown portion 12 can be made not to have a concave portion that extends in a direction d1, other than the concave portion 16 as according to the embodiment. Furthermore, the crown portion 12 may not have a concave portion other than the concave portion 16 regardless of the direction. On the other hand, if more importance is placed on further reducing the air resistance to the golf club head than the sense of incongruity of the golfer at address, a concave portion may be provided other than the concave portion 16.

Figure 5A:
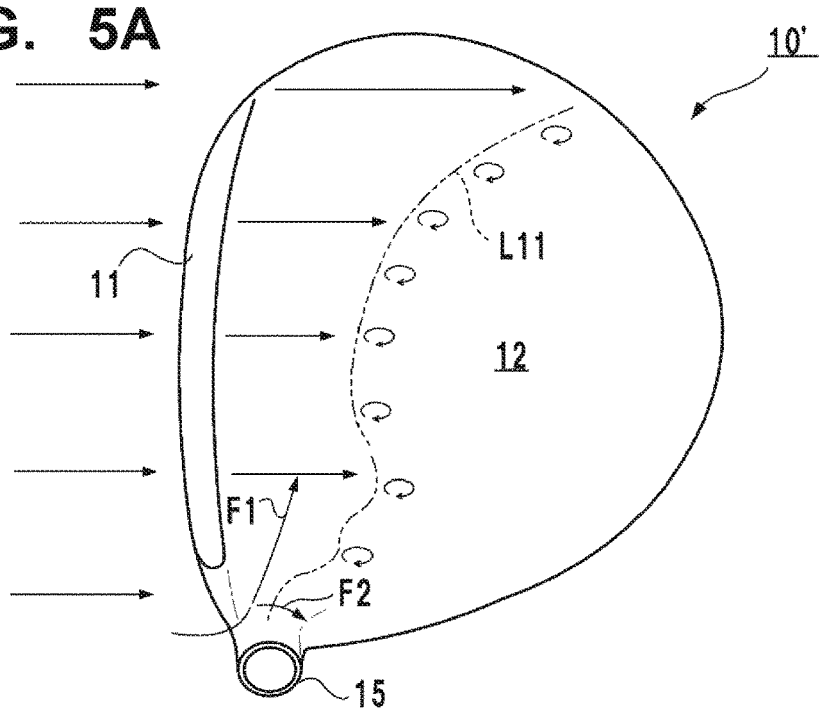
FIG. 5A is a view for explaining the airflow of the comparative example at impact.
Figure 5B:
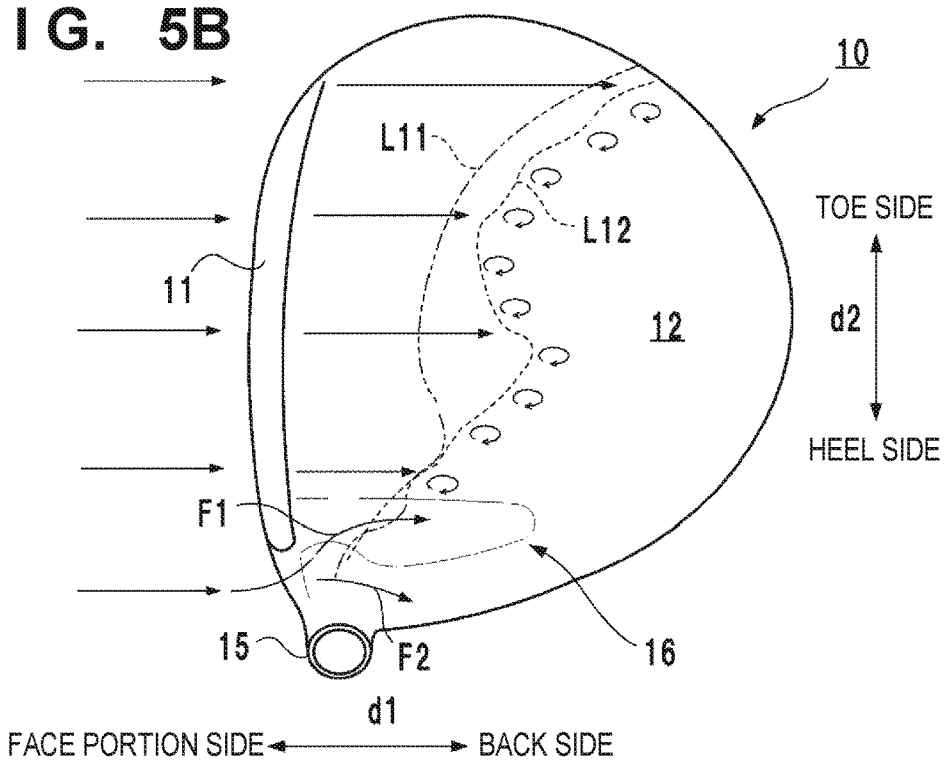
FIG. 5B is a view for explaining the airflow of the golf club head of FIG. 1 at impact.

The effect of reducing the air resistance by the concave portion 16 will be described next with reference to FIGS. 5A and 5B. FIG. 5A is a view schematically showing an airflow that acts on the golf club head 10' immediately before impact as a comparative example. FIG. 5B is a view schematically showing an airflow that acts on the golf club head 10 of the embodiment immediately before the impact.

As shown in FIG. 5A, immediately before impact, the airflow to the golf club head 10' flows in the face-back direction. An airflow flowing on the surface of the crown portion 12 changes to a laminar flow on the side of the face portion 11 and separates halfway. A line 11 exemplifies the position where the airflow separates. The earlier the separation of the airflow, the larger the air resistance to the golf club head 10.

The airflow around the hosel portion 15 can separate into an airflow F1 which flows on the toe side of the hosel portion 15 and an airflow F2 which flows on the heel side. If the airflow F1 flows over the crown portion 12, as shown in FIG. 5A, it may cause a turbulent airflow on the crown portion 12 and promote the airflow to separate. As a result, the airflow on the crown portion 12 separates early, and the air resistance to the golf club head 10' is increased.

In the case of the embodiment shown in FIG. 5B, due to the presence of the concave portion 16, the airflow F1 is guided by the concave portion 16 to flow to the back side. Hence, the airflow F1 is suppressed from flowing upward from the crown portion 12, the separation position of the airflow is shifted toward the back side as indicated by a line L12, and the air resistance to the golf club head 10 is decreased.

In this manner, according to the embodiment, the airflow F1 flowing on the crown portion 12, out of the airflow around the hosel portion 15, can be guided toward the back side by the concave portion 16. The adverse influence from the airflow flowing over the golf club head 10 at impact to the hosel portion 15 can be accordingly suppressed, and higher head speed can be implemented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-218751, filed Nov. 6, 2015, which is hereby incorporated by reference herein in its entirety.

What is claimed is:

1. A golf club head comprising:

a crown portion;

a sole portion;

a face portion; and a hosel portion, wherein the crown portion includes a concave portion that starts from a heel-side portion of the face portion which is toward a heel side from a center of the face portion in a toe-heel direction, passes through a boundary portion of the hosel portion and the crown portion on a toe side of the hosel portion, does not pass through a heel side of the hosel portion, and extends toward a back side, the concave portion includes a range from the face portion toward the back side where a width of the concave portion is larger than a depth of the concave portion, the concave portion is disposed distant from a center point of the crown on a line extending between the hosel portion and an outermost toe portion of the golf club head, the range passes on a toe side of the hosel, the concave portion includes an edge on a side of the face portion, the edge being recessed from an upper edge of the face portion to the sole portion, and the crown portion does not include, other than the concave portion, a concave portion extending in a face-back direction.

2. The golf club head according to claim 1, wherein the width of the concave portion increases along an outer face of the hosel portion from a toe-side end of the outer surface of the hosel portion to a side of the face portion.

3. The golf club head according to claim 1, wherein the concave portion continues to an upper surface of the crown portion by gradually decreasing the depth toward the back side.

4. The golf club head according to claim 1, wherein a continuously connected curved surface is formed from a toe-side outer face of the hosel portion to a deepest part of the concave portion.

5. The golf club head according to claim 1, wherein in planar view of the head, the edge of the concave portion on the side of the face portion is positioned on the same line as the upper edge of the face portion.

6. The golf club head according to claim 1, wherein the width of the concave portion is in a range from 5 mm (inclusive) to 40 mm (inclusive), and the depth of the concave portion is in a range from 1 mm (inclusive) to 10 mm (inclusive).

7. The golf club head according to claim 1, an edge of the concave portion on the back side is in the crown portion.

* * * * *